United States Patent [19]

Hilkenmeier et al.

[11] Patent Number: 4,988,223

[45] Date of Patent: Jan. 29, 1991

[54] MATRIX PRINTING HEAD WITH PIVOTABLE ARMATURES

[75] Inventors: Jürgen Hilkenmeier, Paderborn; Hans W. Volke, Salzkotten, both of Fed. Rep. of Germany

[73] Assignee: Protechno Ces GmbH & Co Kg, Salzkotten, Fed. Rep. of Germany

[21] Appl. No.: 272,680

[22] PCT Filed: May 7, 1988

[86] PCT No.: PCT/EP88/00393

§ 371 Date: Nov. 7, 1988

§ 102(e) Date: Nov. 7, 1988

[87] PCT Pub. No.: WO88/08792

PCT Pub. Date: Nov. 17, 1988

[30] Foreign Application Priority Data

May 8, 1987 [DE] Fed. Rep. of Germany ..... 3715304

[51] Int. Cl.[5] ..... B41J 2/27; B41J 2/235

[52] U.S. Cl. ..... 400/124; 101/93.05

[58] Field of Search ..... 400/124; 101/93.05; 335/274, 275

[56] References Cited

U.S. PATENT DOCUMENTS

| | | | |
|---|---|---|---|
| 4,407,591 | 10/1983 | Adauoli | 400/124 |
| 4,428,691 | 1/1984 | Suzuki | 400/124 |
| 4,522,122 | 6/1985 | Mazumder | 101/93.02 |
| 4,575,268 | 3/1986 | Yang | 400/124 |
| 4,767,227 | 8/1988 | Mitsuishi | 400/124 |

FOREIGN PATENT DOCUMENTS

| | | | |
|---|---|---|---|
| 9873 | 4/1980 | European Pat. Off. | 400/124 |
| 2073497 | 10/1981 | United Kingdom | 400/124 |

*Primary Examiner*—Edgar S. Burr
*Assistant Examiner*—Ren Yan
*Attorney, Agent, or Firm*—Sprung Horn Kramer & Woods

[57] ABSTRACT

In a matrix printing head having a plurality of printing wires, mounting the printing wires for sliding movement between a non-printing rest position and a printing position, a first electromagnet for driving each printing wire from the rest position to the printing position including an electromagnet comprising a yoke having a pole surface, a winding and a pivotable armature connected to each wire and having a pivot, the improvement comprising a second electromagnet for pulling the armature away from the pole surface and forming an armature stop to define the rest position and forming a gap between the armature and the pole surface, wherein each electromagnet comprises a structure composed of light metal and forming segmental recesses therein for receiving the yokes and windings and secured therein with a casting compound, wherein the light metal structure has one face in a plane and wherein the pole surfaces are in said plane, spacer members disposed between the face of the light metal structure and the armature stop and composed of sheet metal, wherein a first spacer member has first segmental cutouts extending radially inwardly and accommodating the armatures and second segmental cutouts accommodating the armature pivots and two second spacer members having segmental cutouts accommodating the armatures, wherein the first spacer member is disposed between the two second spacer members and wherein the gap is defined by the difference between the thickness of the spacer members and the armature and controls for supplying current to the windings.

14 Claims, 4 Drawing Sheets

MATRIX PRINTING HEAD WITH PIVOTABLE ARMATURES

BACKGROUND OF THE INVENTION

The invention concerns a matrix printing head with articulated-armature magnets mounted in a circle, with each armature connected to a matrix pin that slides back and forth in a guide more or less in the center of the configuration of magnets, with mechanisms mounted on the armatures that act against the force of attraction exerted by the magnets and return the armatures to a position in which they rest against an armature stop when there is no current flowing through the magnets, leaving an interferric gap of a prescribed width that equals the thickness of the armature plus that of a spacer between each armature and the faces of the magnet's poles, all of which are in one plane, whereby the armatures pivot in the spacer and whereby an armature stop with a flat surface that limits the travel of the armatures is mounted on the faces of the spacer.

A matrix printing head with a similar configuration of articulated-armature magnets is known from German OS No. 2 110 410. The individual magnets in that device are mounted on a base plate along with the armatures, supporting mechanisms, and armature-return mechanisms. The drawback of this system is that, since the interferric gap between the armatures and the magnets is only a few tenths of a millimeter wide, as is necessary for high-speed printing heads, either each armature must be manually adjusted individually with special tools or a lot of expense must be devoted during the manufacturing process to ensure that all the components, specifically the armatures, yokes, and armature-travel limiting structures will remain dimensionally stable. Furthermore, the magnetic coils cannot be allowed to consume too much power due to the small heat-transmission cross-section in relation to the housing of the magnetic head, which dictates and limits the size and operating speed of the magnets.

A matrix printing head with an armature that is turned and milled from a ferromagnetic blank is known from German No. 2 201 049 B2. Although the ends of the armature are in the same plane, they can be aligned in that plane only by turning and not by lapping because of the presence of an elevated edge with a groove for securing the armature that does not allow further processing. Since the armature rests against the yoke in the center, the width of the interferric gap is dictated by the distance between a cover-support surface and the face of the armature, by the thickness of the stop, and by the thickness of the armature, and accordingly depends on, among other factors, the mutual tolerance to which the face and the supporting surface can be turned.

A system of magnets for a matrix printing head with flat pole surfaces and with an armature-supporting surface and an armature surface positioned in the same plane with no interferric gap is known from German No. 3 149 300 A1. Thus, there is no interferric gap to act as an energy buffer, and the force of impression is derived from a spring, which entails precise tolerances. The absence of a definite interferric gap leaves the speed of retraction completely undefined.

A system of articulated-armature magnets for a line printer with an electromagnetic recuperating magnet is known from German GM No. 1 923 036. Its armature is in the form of a bent lever, one arm of which has a hammer mounted on it and the other arm of which constitutes the actual armature. The end of the armature is wider, and the pole surfaces of the magnets, which are positioned on each side, are at an angle to each other, which makes the mechanism complicated to assemble. Since the armature is several times larger than any of its magnetically active regions, it operates much more slowly than a simple magnet.

The object of the invention is to disclose a simple and relatively small system of articulated-armature magnets for a matrix printing head that will dissipate heat well, that will be provided with a well defined and uniform interferric gap as the result of assembly alone, and that will necessitate no additional expenditure from securing the armature.

SUMMARY OF THE INVENTION

This object is attained in that the yokes 3 of the magnets are secured with casting compound in segmental recesses 42 & 14 in a metal structure 1, the pole surfaces S2 are in the same plane as one face S1 of the metal structure, and the spacer, which is stamped out of sheets of metal with a narrow tolerance and sandwiched, is mounted on that face, whereby the blanks of sheet metal have segmental cutouts 75 & 72 that extend inward and accommodate the armature 5 and there are other cutouts 76 in the inner blank 70 of sheet metal that accommodate pivots 52 in the armature, and in that the armature stop is mounted on that spacer and resting against flat armature-stop surface in such a way that the width of the interferric gap is dictated only by the thickness of the armature and by one thickness of the spacer.

Advantageous embodiments are disclosed herein.

The spacer is made out of stamped and sandwiched blanks of sheet metal, preferably out of three blanks. Wider cutouts are preferably stamped into the inner blank of the sandwich to accommodate a pivot on the armature. The articulated-armature magnets are mounted in a practical way on a base plate with recesses, and the windings are then slid over them and soldered in place. The light-metal structures are drilled out to accommodate the coils and the base plate.

The casting compound is introduced after the magnets have been installed, and the faces and pole surfaces are jointly ground to provide a defined reference surface for assembling the spacers. The spacers can easily be stamped out of sheet metal with narrow tolerances. Since all the armatures in one head are jigged together into one set and ground before the pivots are inserted, there is only one grinding process, specifically the one that relates to all the interferric-gap widths that dictate the thickness of the armature, which accordingly exhibit practically no difference. When all the armatures are ground in the same process, it is an advantage to radially taper the pole surfaces of the armatures in relation to the pivots to ensure flat surface-to-surface contact not only at the pole surfaces but also at the surfaces of the stops in order to increase the attenuation and minimize the residual gap. Since the face of the stop that faces the armature is also ground, the interferric gap and hence the stroke traveled by the armature will be dictated by the thickness of the spacer or by the overall thickness of the blanks that comprise it minus the thickness of the armature. This ensures that the flights traveled by the armatures until the pins strike the paper will all be of equal duration, which results in characters that will be precisely up to standard because the site of pin impact will be subject to practically no displacement on the paper in relation to the position that they should occupy with respect to the direction that the head moves in at normal printing speed. The importance of this chronological printing precision increases with the speed of character sequence and to allow a printing-head advance rate of 200 characters per second in a rapid-writing head, which corresponds to an advance of 50 cm/sec. The precise flight of the pins over time and the resulting satisfactory printing quality at a high character speed entails the advantage of high-resolution characters with 24 or 36 pins for example at near letter quality and high speed with a corresponding number of armatures and pins. It is also possible to advantageously to position an additional spring at the recuperation end of the armature to supplement recuperation and braking.

One especially advantageous embodiment allows rapid operation in a design that is simple to manufacture. Armature-return mechanisms and armature stops in the form of armature-return electromagnets that act on the same armature are secured with their yokes and windings mirror-inverted with respect to attraction magnets inside a metal structure on the spacer, whereby the windings can be connected to controls that supply current to the return magnets only when the mirror-inverted attraction magnets have no current traveling through them.

To simplify the design and ensure an interferric gap with a narrow tolerance, the spacer is made out of three stamped and sandwiched blanks of sheet metal. Wider cutouts are preferably stamped into the inner blank of the sandwich to accommodate a pivot on the armature. The articulated-armature magnets are mounted in a practical way on a base plate with recesses, and the windings are then slid over them and soldered in place. The light-metal structures are drilled out to accommodate the coils and the base plate. The casting compound is introduced after the magnets have been installed, and the faces and pole surfaces are jointly ground to provide a defined reference surface for assembling the spacers. The spacers can easily be stamped out of blanks of sheet metal with narrow tolerances. Since all the armatures in one head are jigged together into one set and ground before the pivots are inserted, there is only one grinding process, specifically the one that relates to all the interferric-gap widths that dictate the thickness of the armature, which accordingly exhibit practically no difference.

The high-speed printout attainable with the narrow interferric-gap tolerances and with the armature being recuperated with a spring can be accelerated by associating an armature-return mechanism in the form of an electromagnet instead of a spring with each attraction magnet in an articulated armature. The operating magnet must be able to move only the armature and the pin when no current is flowing through the armature-return magnet and to apply sufficient impact energy dot printing. Since the armature-return magnet does not need to be tensioned, an approximately 30% higher printing speed can be attained with the same size components and the same operating conditions.

The armature-return magnets are preferably positioned mirror-inverted in relation to the attraction magnets and they are correspondingly simple to manufacture. When they are inactivated, the pole surfaces of the armature-return magnets act as a stop for the armature. Since less power is needed for return of the armatures because the impact energy of the pins that is not consumed during the printing process causes the pins to rebound, the armature-return magnet can have shorter legs and smaller coils. Since, because the residual gap is very narrow, only a relatively slight number of ampere turns, approximately 2% of the number of turns around the armature-attraction magnets, is necessary to retain the returned armature, the losses that occur in the windings during retention and that are known to depend on the square of the number of ampere turns, will be only about 0.5 per mil.

It is also possible and to advantage to associate a spring or a permanent magnet with the driving or return end of the armature in order to augment activation or return and retention. The non-linear pole-force characteristic of an armature-return magnet can be completely exploited without special expenditure if the pole surfaces of the permanent magnet are processed along with those of the electromagnet during the grinding process, ensuring flat surface contact on the part of the armature. Powerful shearing on the part of the force of the permanent magnet as the result of a wide interferric gap left at the rear in relation to the reflux yoke and created by the armature-return magnet, prevents any noticeable effects on the magnetic force due to fluctuations in temperature.

The armature can be advantageously mounted practically without tension or torsion in relation to the poles of the magnet and to the pins if the pins and/or pivots are welded to the armature in situ, preferably with a laser beam or electron beam. To center the armature precisely in the magnetic field, the electromagnets are advantageously excited with a pulsed current before welding and subjected to a continuous current during welding.

The drawings illustrate advantageous embodiments, wherein:

DETAILED DESCRIPTION OF THE INVENTION

Figure 1:
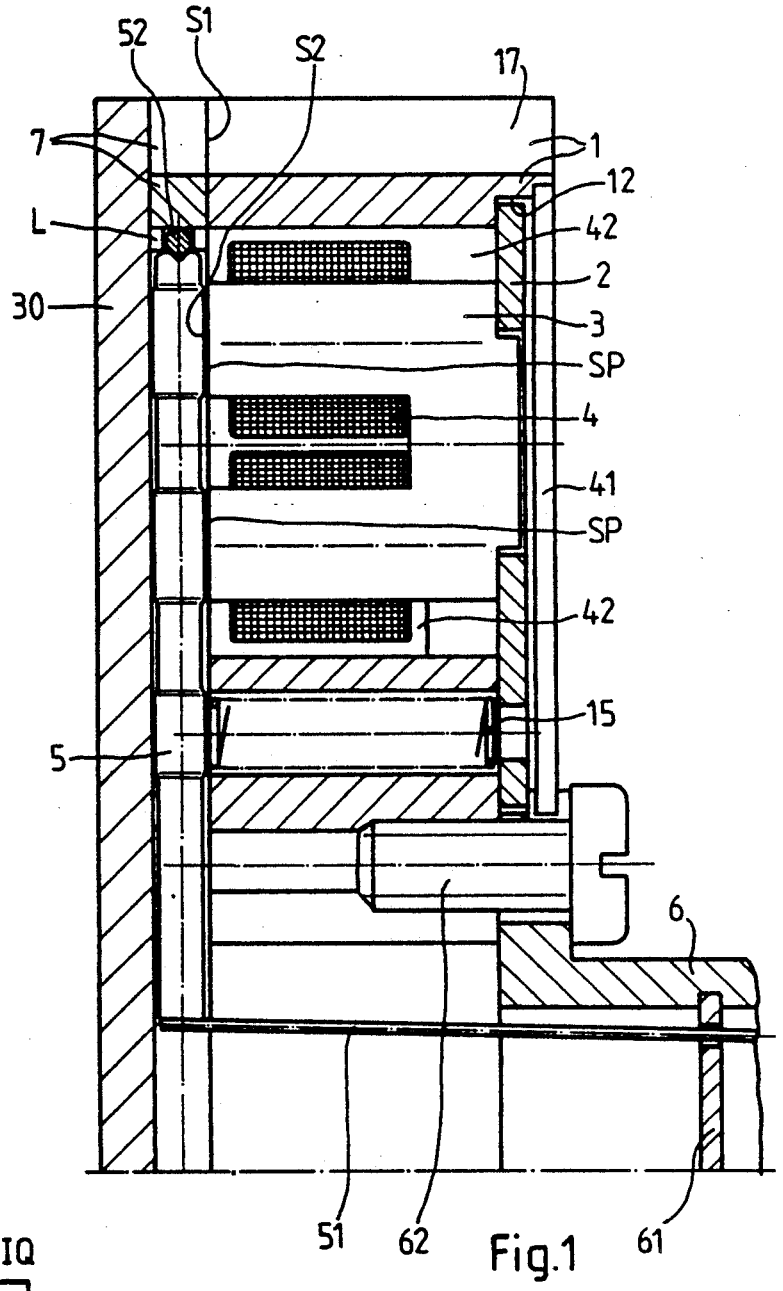
FIG. 1 is a magnified axial section through a matrix printing head.

FIG. 1 is a section, magnified approximately five times and extending radially out from a midline M (FIG. 9), through a matrix printing head with a light-metal structure 1 into which is cast an attraction-magnet yoke 3, on which is mounted a winding 4. Attraction-magnet yoke 3 is accommodated in a recess in a base plate 2. Base plate 2, which accommodates all the attraction magnets along with their windings 4 and electric connections, is secured in a bore 12 in the center of light-metal structure 1. Segmental recesses 42 in light-metal structure 1 are filled with casting compound that dissipates the heat from magnet windings 4. Satisfactory heat dissipation is promoted by cooling fins 17 on the outer surface of light-metal structure 1, and the webs between the magnets also dissipate heat. A casting compound with high heat conductivity is employed, with particles of metal as a filler for example. The face S1 of light-metal structure 1 and the pole surfaces S2 of attraction-magnet yokes 3 are ground in common. Mounted on face S1 is a spacer 7, including spacers 70, 71, and 71A (FIG. 9), in which is articulated an armature 5 occurrence surrounded by lubricant L. Secured to the end of armature 5 that extends toward the center of the head is a matrix pin 51. Pins 51 slide back and forth toward an unillustrated printing die in web-shaped channels 61. Pin channels 61 are accommodated in a known way in a housing 6 that is secured by means of screws 62 in cylindrical grooves 18 in light-metal structure 1. The rear of armatures 5 rest against a ribbed armature stop 30.

Figure 9:
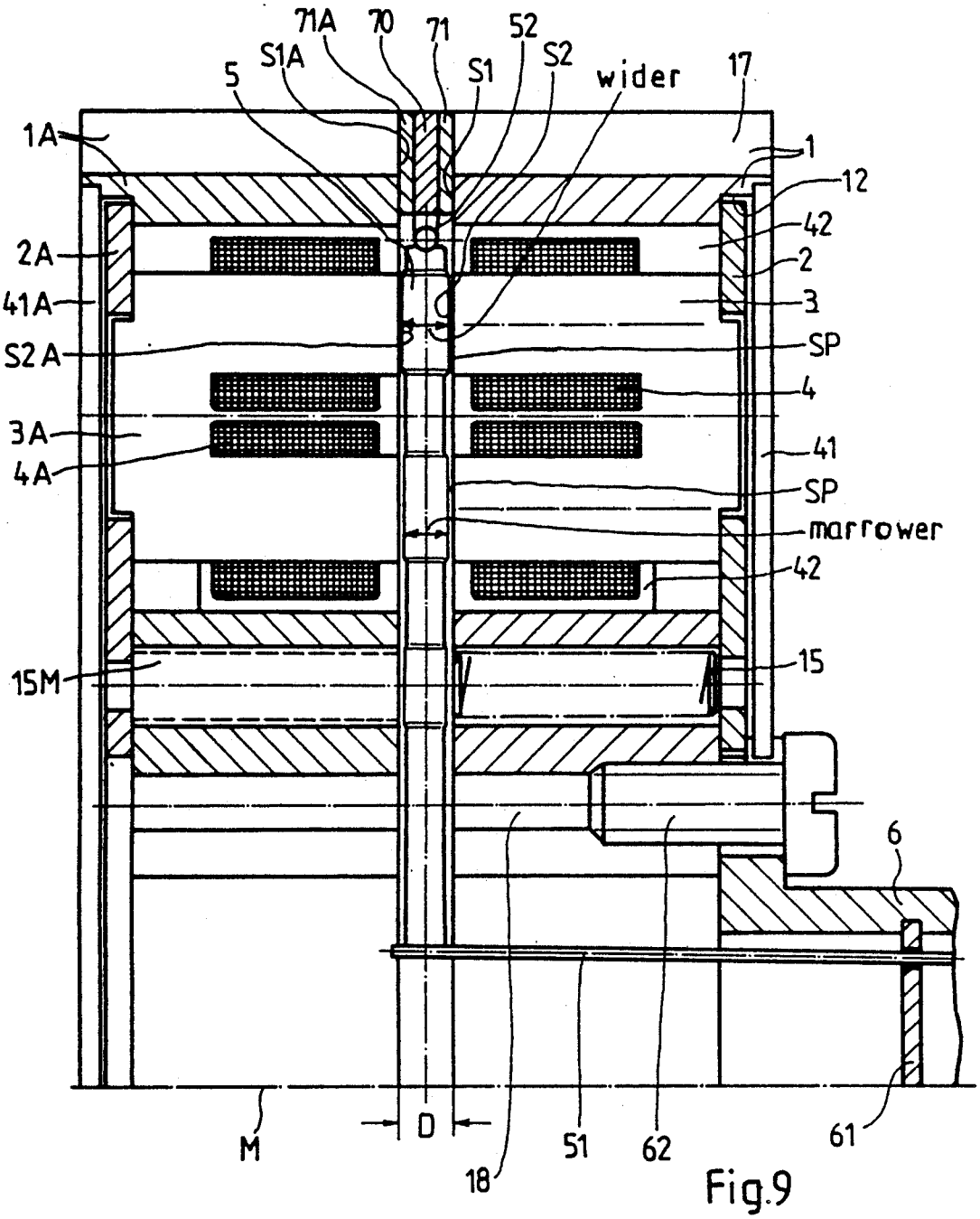
FIG. 9 is a magnified section through a matrix head with armature-return magnets.
Figure 11:
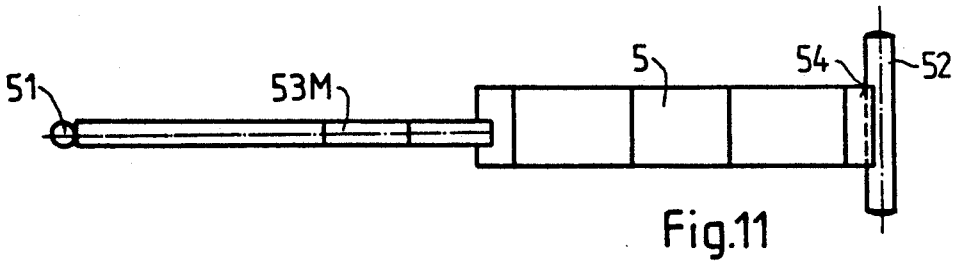

The swing of armature 5 is limited by their impact surfaces, which are ground even with the supporting surface S1A of the armature stop on spacer 71A, 70, and 71 (FIG. 9). An interferric gap SP for the articulated-armature magnets accordingly derives from the difference between the overall thickness D of the spacer and the thickness of the armature.

The mechanism that returns armature 5 is a compression spring 15 that engages armature 5. Springs 15 are accommodated in cylindrical openings in light-metal structure 1.

Other details of the design will be evident from the approximately double-scale representations in FIGS. 2 through 7.

Figure 2:
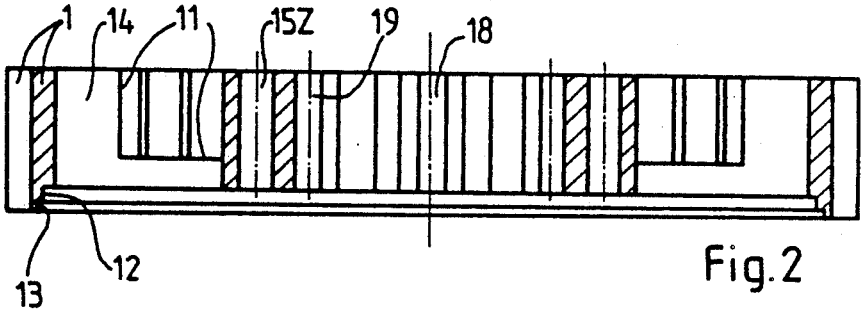
FIG. 2 is an axial section magnified at a different scale through the light-metal structure.
Figure 4:
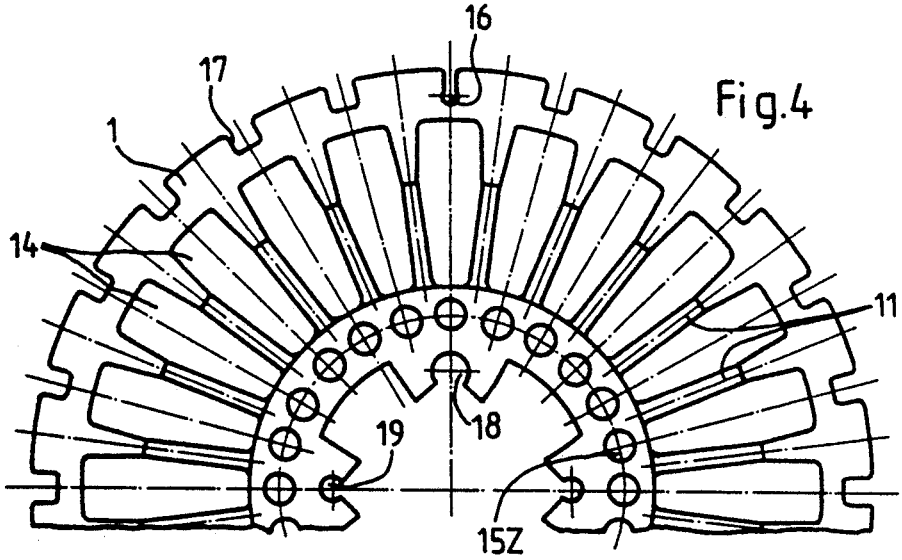
FIG. 4 is a section of a view of the light-metal structure in FIG. 2.

FIG. 2 is an axial section through a light-metal structure 1 and FIG. 4 is a partial top view of its face. The extruded structural section has segmental recesses 14 that can accommodate 24 magnets and are expanded by a bore 11 in the vicinity of the windings. Cylindrical recesses 15Z for the armature-return spring or armature-return magnets are introduced in radial alignment with recesses 14. Cooling fins 17 and orientation channels 16 for bolt alignment are shaped into the outer surface. Inside is a channel for accommodating the printing wires. Shaped onto the channel are cylindrical and undercut grooves 18 and 19 for fastenings.

In addition to grooves 18 & 19, recesses 14, and depressions 15Z, FIG. 2 also illustrates the bores 11, 12, and 13 that accommodate the windings, the base plate, or the cover plate.

Figure 3:
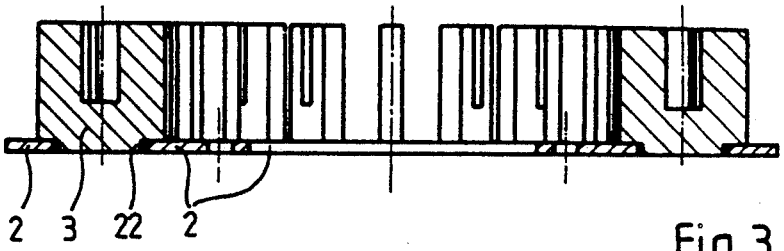
FIG. 3 is an axial section at the same scale as that in FIG. 2 through a base plate with magnetic yokes resting on it.
Figure 5:
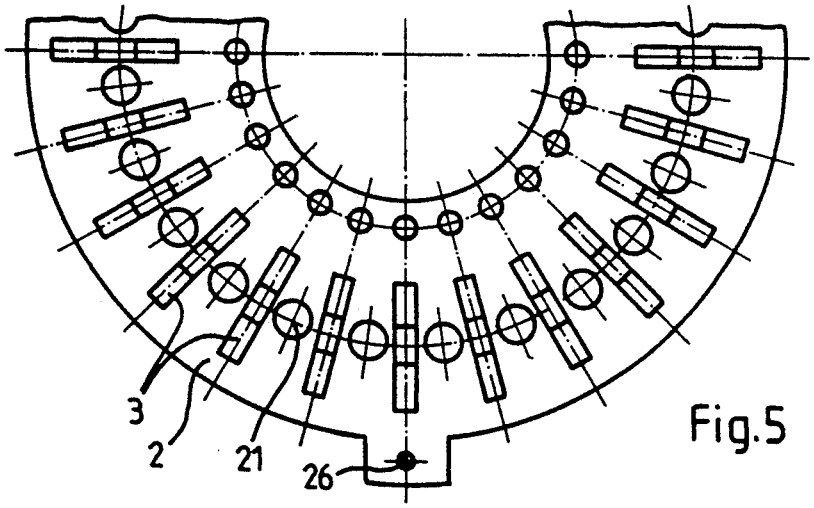
FIG. 5 is a section of a view of FIG. 3.

FIGS. 3 and 5 are a radial section through and a top view of the pole surfaces of a base plate 2 with attraction-magnet yokes 3 inserted into it. Yokes 3 are secured in stamped-out holes 22. Also in base plate 2 are stamped-out holes 21 that allow the ends of the windings to extend through it and orientation holes 26 for bolting to the orientation channels. Wires for connecting the windings are also mounted on base plate 2.

Figure 6:
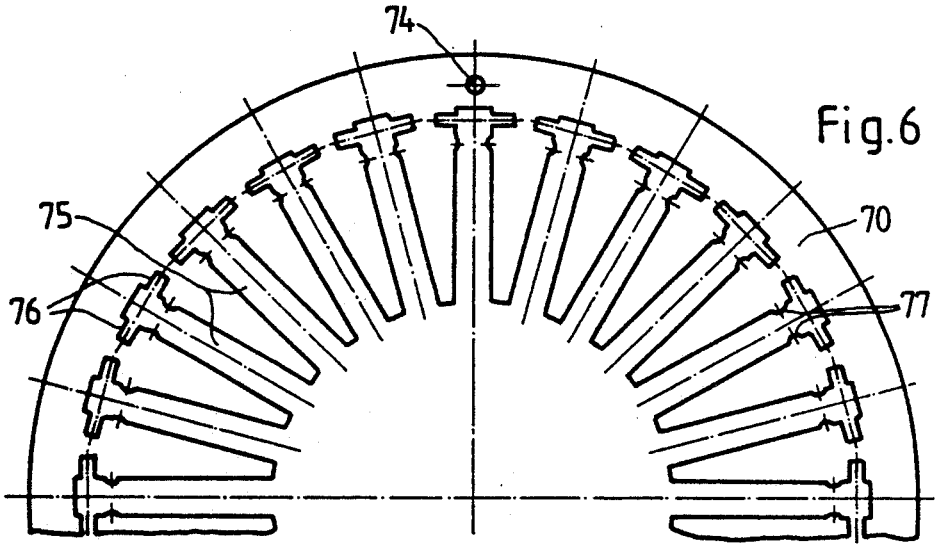
FIG. 6 is a section of a spacer and bearing block.
Figure 7:
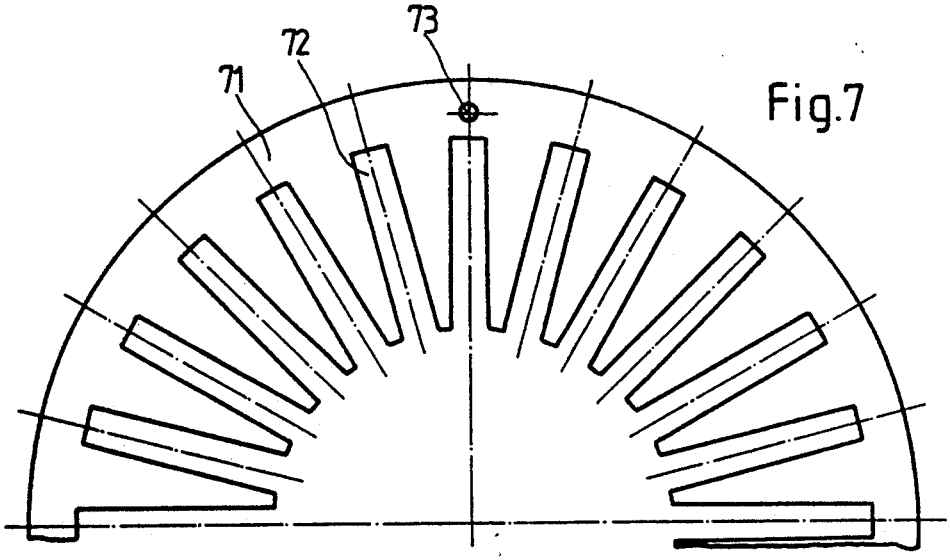
FIG. 7 is a section of a spacer made out of sheet metal.

One advantageous embodiment of a spacer is illustrated in FIGS. 6 and 7. FIG. 6 illustrates part of a blank stamped out of thin metal that acts in the capacity of an inner sheet-metal mounting blank 70 and has inwardly segmental cutouts 75 for accommodating the armatures. Segmental cutouts 75 have laterally wider bearing chambers 76 that accommodate the pivots 52 illustrated in FIG. 8. Positioning noses 77 on each side in the vicinity of bearing chambers 76 guide the armatures laterally. Orientation holes 74 make it possible to bolt this component to the other blanks of sheet metal and to the light-metal structure.

FIG. 7 illustrates part of the other sheet-metal spacers 71 that demarcate the position of the pivots on each side of the inner sheet-metal blank, creating extensively closed bearing chambers that are in a practical way filled with permanent lubricant. Segments 72 that allow the armatures to move freely are stamped out of the sheet metal, which also has holes 73 for orienting and bolting.

Figure 8:
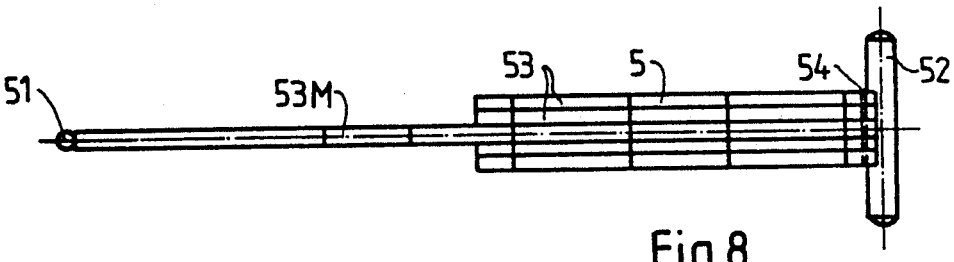
FIG. 8 is a top view of an armature at the same scale as FIG. 1.

FIG. 8 is a top view of an armature 5 sandwiched together from stamped-out blanks 53 and 53M of sheet metal. Inner blank 53M extends to whatever pin-attachment length is most practical, and a matrix pin 51 is welded to its face. Welded into a groove 54 at the opposite end is a pivot 52. FIG. 1 illustrates the position of pivot 52 in groove 54 in section. The thickness of pivot 52 equals that of the inner blank of sheet metal to close tolerance.

Instead of being made out of blanks of sheet metal, the armature can also be a sintered component. Positioning the pivot eccentrically in the spacer and using only two blanks of sheet metal or a length of extruded section for the spacer would be apparent to one of skill in the art. A wedge-shaped armature that tapers in accordance with the angle at which it pivots can also be employed to optimal effect instead of an armature that is uniformly thick in the vicinity of the poles.

FIG. 9 illustrates an amplification of the design illustrated in FIG. 1. It employs armature-return electromagnets 3A and 4A. An armature-returning mechanism in the form of a return electromagnet 3A and 4A engages armature 5. A compression spring 15 and/or a permanent magnet 15M can also be accommodated in cylindrical openings in metal structure 1 and 1A. Armature-return electromagnets 3A and 4A are positioned symmetrical with respect to armature 5 and mirror-inverted with respect to armature-attraction magnets 3 and 4 and are also secured in a base plate 2A and cast into a light-metal structure 1A. The pole surfaces of armature-return magnets 3A constitute armature-stop surfaces S2A. Base plates 2 and 2A are sealed off on the outside by cover plates 41 and 41A.

Figure 10:
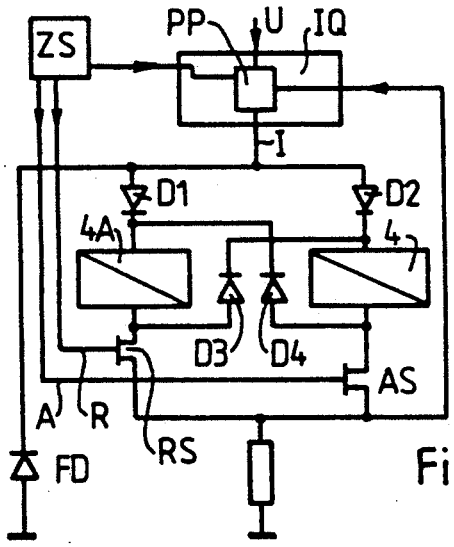
FIG. 10 illustrates a circuit for controlling an attraction magnet and a return magnet.

FIG. 10 illustrates circuitry for controlling the windings of an armature-attraction magnet and of an armature-return magnet 4 and 4A. Operating voltage U is supplied to a variable source IQ of current that in a practical way contains pulse-pause controls PP and an idling circuit FD. Its output terminal can be switched back and forth by way of controllable switches RS and AS to the winding 4A of the armature-returning mechanism or the winding 4 of the activating magnet. Central printing controls ZS emits an activating signal A to switch AS for a prescribed activating time for each point printed, depending on the desired impact strength and on the particular type of paper being printed. Printing controls ZS simultaneously dictate the current intensity of source IG with a current-intensity control signal or signals IS. An appropriately poled signal R simultaneously opens switch RS and drains the current from armature-return and retention magnet 4A. At the expiration of the activation period, more or less when the pin strikes the paper, control signal A is turned off and signal R turns on the current to the armature-return magnet. It is of advantage for the current to be more or less as intense during the armature-return period as it is during the propulsion period in order to generate more or less the same initial magnetic-field strength in the interferric gap and rapidly reverse the direction that the armature travels in. The result is an essentially lower current intensity due to a change in current-intensity control signal IS, so that, when the armature reaches the stop, it will not rebound but will remain in position and the pin can be activated again either immediately or at any prescribed time with no waiting period.

In one advantageous embodiment of the circuit, the energy from a coil 4 or 4A that has just been disengaged is transferred to the coil that has just been activated at the same instant and that activates the same armature, essentially accelerating the buildup and breakdown of current. The current is allowed to travel from one winding 4 to the other 4A by means of transfer diodes D3 and D4 that constitute a series circuit at alternating ends of the windings, with blocking diodes D1 and D2 disengaging them at opposite ends.

To activate the armature as rapidly as possible and to ensure extensive independence from the saturation property of the magnetic material and especially from its temperature dependence, it is recommended that the ampere turn correspond to approximately 70% of the saturation magnetization of the armature during the attraction phase. Limiting the saturation will also maintain crosstalk from one magnet to another within acceptable limits. In one energy-saving embodiment the ampere turn during the armature-return phase is in a practical way ⅓ of what it is during the attraction phase. The ampere turn is accordingly decreased to a maintenance ampere turn of approximately 2% of the attraction-phase ampere turn.

An especially rapid resetting of the armature between the two magnets that act on it alternately can be attained when the magnetic fields of both magnets extend rectified through the armature as the result of appropriate polarization of the windings. No switchover-turbulence losses or field-establishment delays will accordingly occur in the armature.

An advantageously energy-saving way of supplying current to armature-return magnets 3A and 4A can be attained by exploiting the rebound energy of matrix pins 51 and armature 5 in that, once the attraction-phase current has been discontinued, which occurs more or less when the pin impacts, there will be a delay during which no current is supplied that lasts until the armature is completely reversed, 10 to 20 microseconds for example, only subsequent to which is current supplied to armature-return magnets 3A and 4A at ⅓ to 1/10 the attraction-phase ampere turn until armature 5 arrives at the stop and releases its rebound energy in that position, which requires approximately 3/2 to all of the attraction-phase period. The current intensity is then reduced to the maintenance current intensity of approximately 2% of the attraction-phase current intensity. The aforesaid operating ranges relate to the printing of up to five exploitations and of more than five exploitations. Prescription of the appropriate values independent of application is assumed. It is preferable to vary the prescribed values in such a way that they can be switched between two operating situations. When there are more than five exploitations, the maximum attraction-phase ampere turn is employed and, when there are less than five exploitations, the attraction-phase ampere turn is decreased to ¾ of the maximum.

What is claimed is:

1. In a matrix printing head having a plurality of printing wires, means mounting the printing wires for sliding movement between a non-printing rest position and a printing position, electromagnetic means for driving each printing wire from the rest position to the printing position including an electromagnet comprising a yoke having a pole surface, a winding and a pivotable armature connecting to each wire and having a pivot, an armature stop and means biasing the armature away from the pole surface and into the armature stop to define the rest position and forming a gap between the armature and the pole surface, the improvement wherein the electromagnetic means comprises a structure composed of light metal and having means forming segmental recesses therein for receiving the yokes and windings and secured therein with a casting compound, wherein the light metal structure has one face in a plane and wherein the pole surfaces are in said plane, spacer members disposed between the face of the light metal structure and the armature stop and composed of sheet metal, wherein a first one of said spacer members has first segmental cutouts extending radially inwardly and accommodating the armatures and second segmental cutouts accommodating the armature pivots and a second one of said spacer members having segmental cutouts accommodating the armatures, the first spacer member abutting the armature stop and the second spacer member being disposed between the first spacer member and the pole surface and the gap being defined by the difference between the thickness of the spacer members and the armature.

2. The matrix printing head as in claim 1, wherein the cutouts are filled with a permanent lubricant.

3. The matrix printing head as in claim 1, wherein the armatures taper to correspond with a pivot angle.

4. The matrix printing head as in claim 1, wherein a radially outer end of each armature has a groove in which the armature pivot is secured.

5. The matrix printing head according to claim 4, wherein the armature comprises a laminated structure of sheet metal blanks.

6. The matrix printing head according to claim 4, wherein the armature comprises sintered metal.

7. In a matrix printing head having a plurality of printing wires, means mounting the printing wires for sliding movement between a non-printing rest position and a printing position, first electromagnetic means for driving each printing wire from the rest position to the printing position including an electromagnet comprising a yoke having a pole surface, a winding and a pivotable armature connected to each wire and having a pivot, the improvement comprising second electromagnetic means for pulling the armature away from the pole surface and forming an armature stop to define the rest position and forming a gap between the armature and the pole surface, wherein each electromagnetic means comprises a structure composed of light metal and having means forming segmental recesses therein for receiving the yokes and windings and secured therein with a casting compound, wherein the light metal structure has one face in a plane and wherein the pole surfaces are in said plane, spacer members disposed between the face of the light metal structure and the armature stop and composed of sheet metal, wherein a first one of said spacer members has first segmental cutouts extending radially inwardly and accommodating the armatures and second segmental cutouts accommodating the armature pivots and said spacer members including two second spacer members having segmental cutouts accommodating the armatures, the first spacer member being disposed between the two second spacer members and the gap being defined by the difference between the thickness of the spacer members and the armature and controls ZS for supplying current to the windings.

8. The matrix printing head according to claim 7, wherein the controls comprise an activating circuit connected to the electromagnetic means and comprising a pulse-pause controlled switch PP receptive of a variable source IQ of current for producing an output signal I, controls ZS for switching the output signal I of the switch PP from one winding to another and comprising an idling circuit FD and variable switches AS and RS.

9. The matrix printing head according to claim 8, wherein the activating circuit further comprises current-transfer diodes D3 and D4 in parallel with the windings and separating diodes D1 and D2 in series with the windings.

10. The matrix printing head as in claim 8, wherein the activating circuit includes means for effecting no current flow during an armature direction-reversal period that occurs between each armature-attraction current-flow period and each armature-return current-flow period and the armature-return ampere turn that occurs during a restoration period.

11. The matrix printing head as in claim 10, wherein the activating circuit has means for prescribing the armature-attraction phase ampere turn, the currentless armature direction-reversal period, the restoration period, the armature-return phase ampere turn, and the maintenance ampere turn.

12. The matrix printing head as in claim 10, wherein the armature-attraction phase ampere turn is a maximum during an initial operating phase, the armature direction-reversal phase is approximately 21 microseconds, the restoration period equals the armature-attraction phase and the restoration-period ampere turn is approximately 25% of the armature-attraction period ampere turn and the armature-attraction phase ampere turn is approximately 75% of the maximum ampere turn, the armature direction-reversal phase is approximately 10 microseconds, the restoration period is approximately 3/2 of the armature-attraction phase and the restoration-period ampere turn is approximately $\frac{1}{3}$ of the previous armature-attraction period ampere turn.

13. The matrix printing head as in claim 7, wherein the controls have means for effecting the supply of current to the windings of said first electromagnetic means with a value of a prescribed attraction-phase ampere turn of approximately 70% of a saturation ampere turn throughout a prescribed armature-attraction phase period and the supply of current to said second electromagnetic means subsequent to each phase with an armature-return ampere turn that corresponds to approximately $\frac{1}{3}$ of the armature-attraction phase ampere turn for an armature-return phase period that corresponds to between 3/2 and all of a armature-attraction phase current-supply period and subsequently supply the windings with an ampere turn of approximately 2% of the attraction-phase ampere turn.

14. The matrix printing head as in claim 7, wherein the electromagnetic means has an ampere turn to ensure that its field will be rectified in relation to the field of an armature-attraction ampere turn in the armature.

* * * * *